United States Patent [19]

Uecker

[11] 3,964,419

[45] June 22, 1976

[54] ANTI-FOULING ROLLER FURLING GEAR UPPER ASSEMBLY

[76] Inventor: Ronald L. Uecker, 915 Grant St., Wausau, Wis. 54401

[22] Filed: Nov. 27, 1974

[21] Appl. No.: 527,771

[52] U.S. Cl. ..... 114/106

[51] Int. Cl.[2] ..... B63H 9/10

[58] Field of Search ..... 114/102, 104, 105, 106, 114/107, 108, 109, 111, 112, 114

[56] References Cited

UNITED STATES PATENTS

| | | | |
|---|---|---|---|
| 114,459 | 5/1871 | Meyer | 114/114 |
| 3,251,329 | 5/1966 | Smith | 114/102 |
| 3,811,158 | 5/1974 | Merser | 114/114 |
| 3,851,610 | 12/1974 | Greene | 114/106 |

*Primary Examiner*—Trygve M. Blix
*Assistant Examiner*—Gregory W. O'Connor
*Attorney, Agent, or Firm*—Jacques M. Dulin

[57] ABSTRACT

Furling gear unit comprising a stay slide and a cooperating stay bushing for attachment to the upper end of a forestay extending between the bow and the mast head of a sailing vessel, said unit being attached to the forestay, sail luff wire and sail halyard in such a manner as to prevent fouling by the twisting of the halyard and sail around a stay. The stay slide may be female or male type with the cooperating stay bushing of the opposite type. Predetermined limited rotation around the forestay is achieved by cooperatingly engageable members of the stay slide and bushing. Other embodiments include a single or multiple rotary bearing clamp or housing for retaining or holding one or more rotary bearing assemblies. The rotary bearing is adapted to have the upper end of a sail luff wire attached thereto and the bearing housing, or strut connecting the bearing housing to the stay slide, is removably attachable to the sail halyard and is constructed in a manner to prevent rotary motion being transferred to the sail halyard when the sail is furled or unfurled. Several embodiments of the specially adapted, cooperating stay bushing are illustrated, including prefabricated and user-assemblable types, which optionally may use a special locking collar. Quick mount/dismount stay slides are also disclosed.

59 Claims, 47 Drawing Figures

Fig. 12
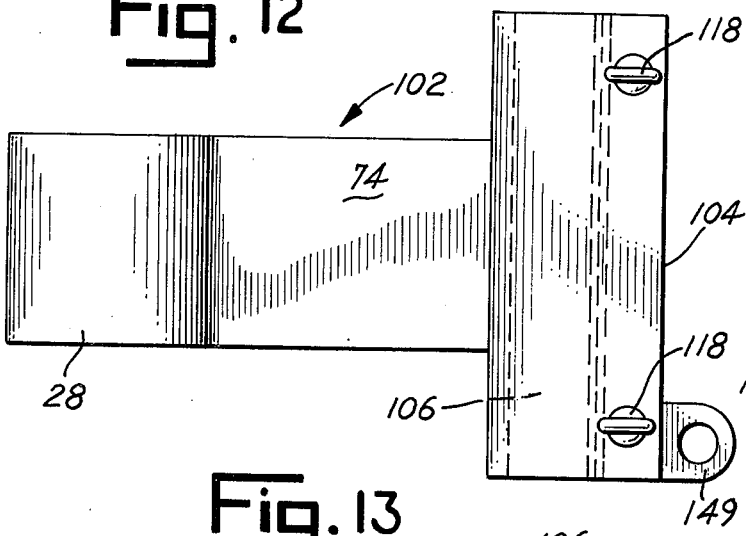
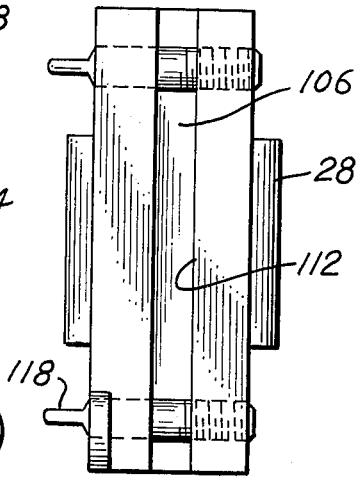
Fig. 14
Fig. 13
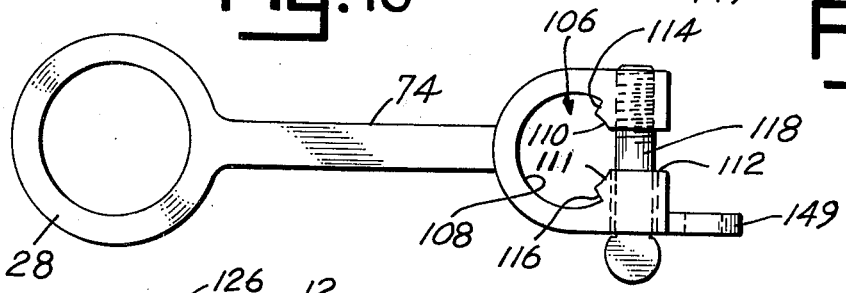
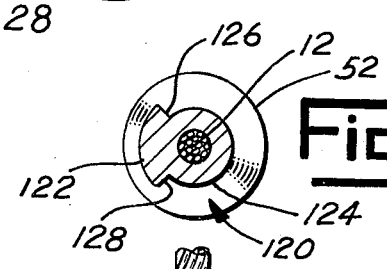
Fig. 15a
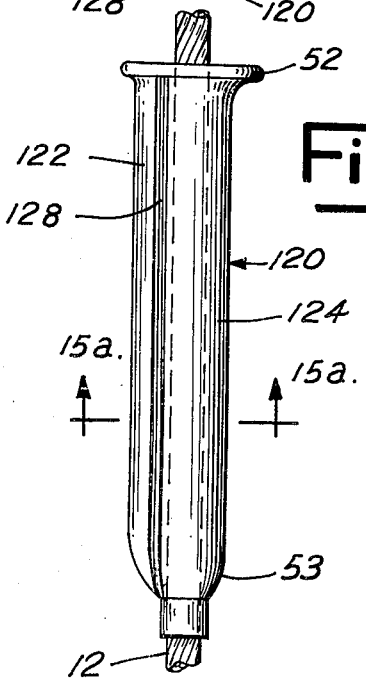
Fig. 15
Fig. 16
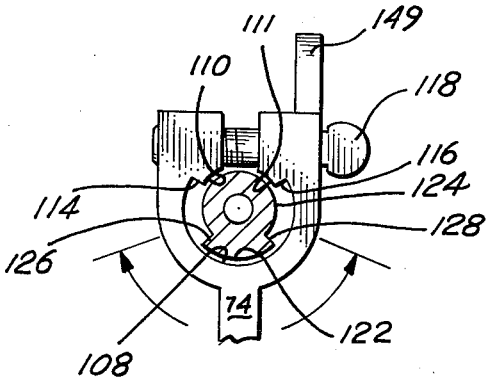

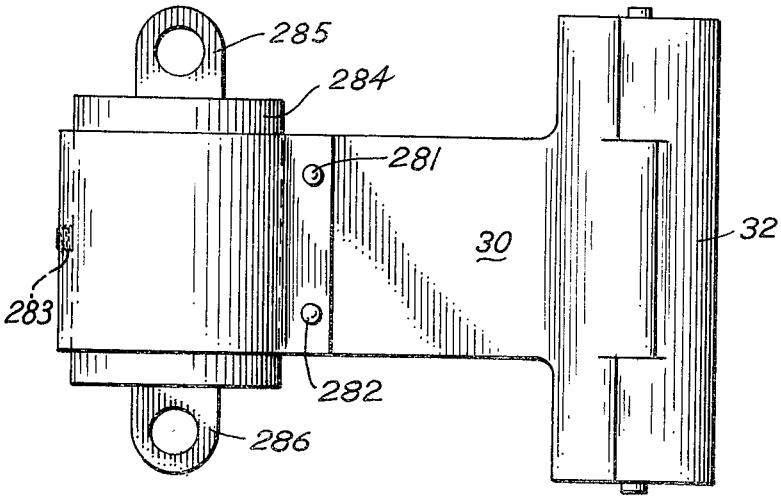
Fig. 17
Fig. 18
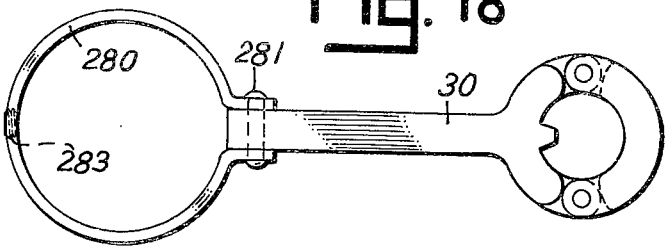
Fig. 19
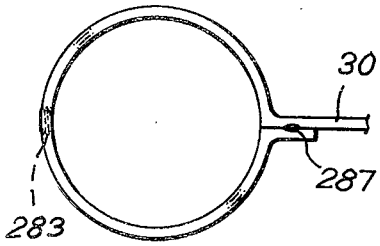
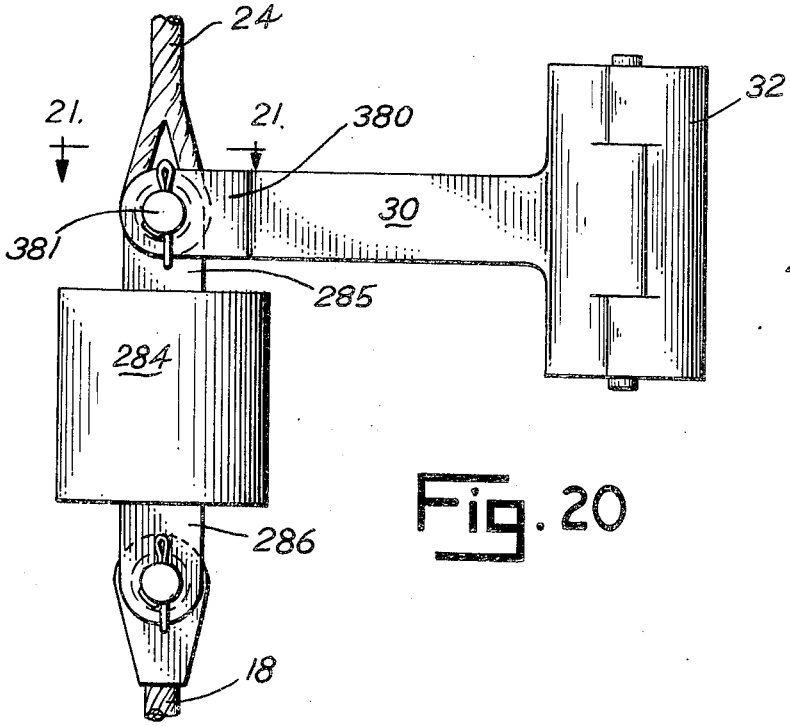
Fig. 20
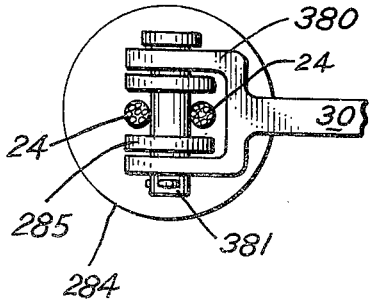
Fig. 21

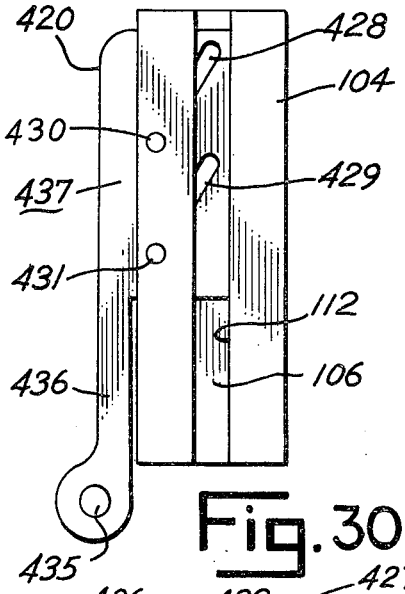
Fig. 30
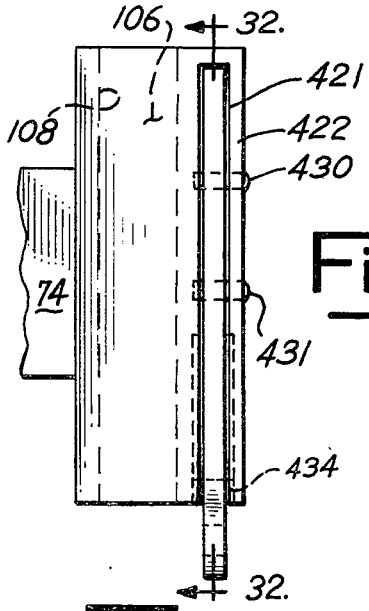
Fig. 31
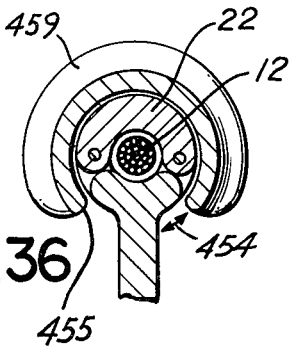
Fig. 36
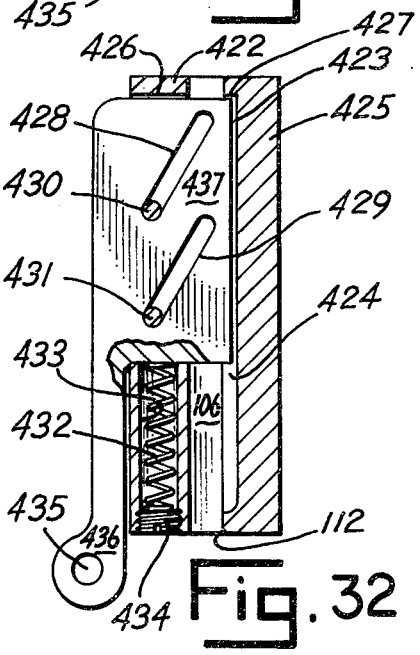
Fig. 32
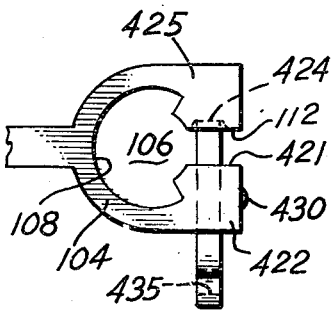
Fig. 33
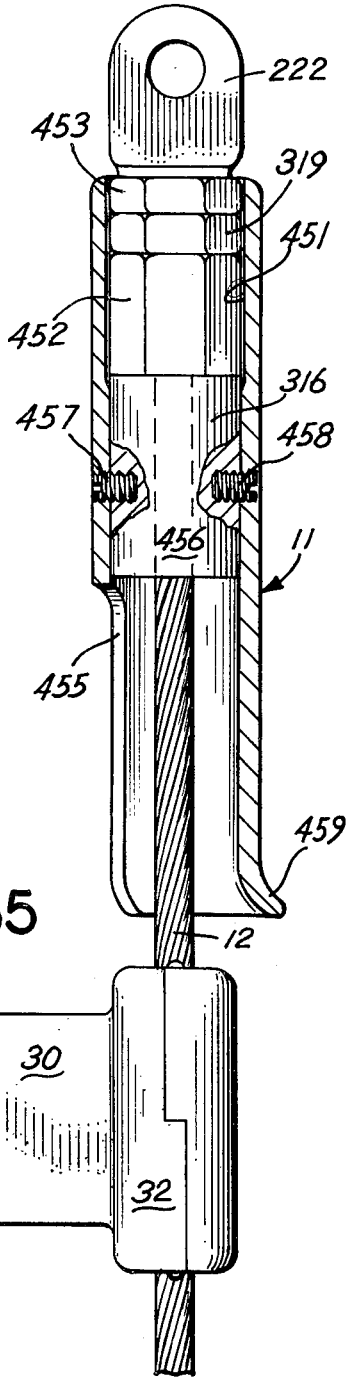
Fig. 35
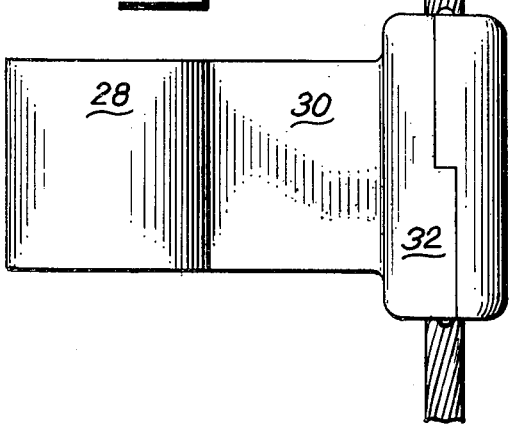
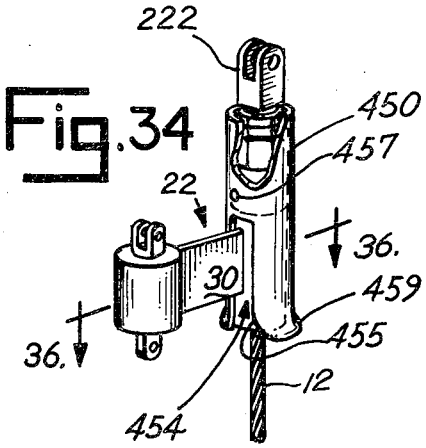
Fig. 34

ANTI-FOULING ROLLER FURLING GEAR UPPER ASSEMBLY

FIELD

This invention relates to anti-fouling furling gear for use in connection with sails, and more particularly to upper furling gear assemblies.

BACKGROUND

Roller sail furling and reefing gear has been in use on sailing vessels for many years. Such gear consists basically of an upper rotary bearing or swivel and a rope drum attached to the deck, the drum also being equipped with a rotary bearing. The sail is fitted with a wire rope sewn into its leading edge or luff. The ends of this luff wire are shackled to the upper rotary bearing and to the top of the rope drum. The furling rope is wound on the drum.

To furl the sail, the rope is pulled off the drum as the sheet of the sail is slacked off, and the sail is rolled up around its rotating luff wire, the wire being rotated through its attachment to the drum. To unfurl the sail, the sheet of the sail is pulled while the rope to the drum is slacked off. As the sail unrolls, the luff wire rotates causing the rope drum to rotate and wind the rope upon it ready for furling the sail again when needed.

The sails equipped in the above-described manner can be used without a stay; that is, no mast stay is necessary as the luff of the sail is not clipped to the stay as with conventional sails. In such instances, however, the luff wire of the sail also acts as a supporting stay for the mast, and the sail cannot be changed if the mast is stressed by heavy weather conditions.

More frequently, the roller furling sail is hoisted behind the stay but unattached to it. This proximity to the stay introduces the danger of twisting of the sail, the sail halyard and rotary bearing around the stay, especially in heavy weather conditions. One attachment currently in use shackles the upper rotary bearing to the stay and does help to prevent rotary motion being transferred to the halyard and twisting it while the sail is being furled or unfurled, but does not prevent rotation of the bearing and attached halyard and sail around the stay, causing twisting and fouling. When the halyard, block, bearing and/or sail get twisted around the stay in heavy weather, it becomes impossible to furl the sail with the rotary gear.

Accordingly, there is a need to provide a device which will prevent transfer of rotary motion to the sail halyard and also prevent rotation of the bearing and its attachments around the stay while furling and unfurling the sail or during heavy weather conditions.

INVENTION

Objects

It is among the objects of this invention to provide furling gear which is effective to prevent rotary motion being transferred to the sail halyard when the sail is being furled or unfurled.

Another object of this invention is to provide furling gear which is effective to prevent rotation of the bearing and sail and halyard around the stay when the sail is being furled or unfurled, or under heavy weather conditions.

Another object of this invention is to provide cooperative stay slide and stay bushing construction which will be effective to control the rotation of the furling gear unit and attachments about the stay to which the furling gear unit is attached.

Another object of this invention is to provide an upper rotary bearing unit, housing, or clamp, and stay slide assembly which is adapted to be attached to the stay and which is constructed to allow predetermined limited rotation or no rotation of the assembly with respect to the stay.

Another object of this invention is to provide specially adapted, pre-assembled or assemblable stay slides adapted to cooperate with the stay bushings to limit rotation of the roller furling gear.

Another object of this invention is to provide an anti-fouling roller furling gear upper assembly.

Another object of this invention is to provide an upper furling gear assembly adapted for roller furling of multiple running sails and having a stay slide and bushing assembly adapted to provide predetermined limited angular movement around the forestay while preventing fouling.

Another object of this invention is to provide quick mount/dismount stay slide assemblies for use in improved anti-fouling roller furling gear upper assemblies.

Another object of this invention is to provide both male and female type stay slides and cooperating bushings for both preassembled and user-assemblable needs.

Another object of this invention is to provide a special anti-rotation collar which prevents loosening of stay terminals.

Another object of the invention is to provide both preassembled and user-assemblable forestay terminals adapted for use with the stay slide and furling gear of this invention.

Other features and objects of this invention are apparent from the detailed description and the accompanying drawings.

BRIEF DESCRIPTION OF THE DRAWINGS

FIG. 1 is a view in elevation of the bow of a sailing vessel using furling gear in accordance with the present invention;

FIG. 12 is a view in elevation of still another embodiment of a furling gear unit showing still another means of attachment to a stay bushing mounted on the stay;

FIG. 13 is a top plan view of the unit of FIG. 12;

FIG. 14 is an end view of the unit of FIG. 12;

FIG. 15 is a view in elevation of a stay bushing to be used with the unit of FIG. 12;

FIG. 15*a* is a view taken along the line 15*a*—15*a* of FIG. 15;

FIG. 16 is a plan view showing a portion of the stay slide mounted on a stay bushing.

FIG. 17 is a side elevation view of another embodiment of the stay slide with collar adapted to be secured to a standard bearing;

FIG. 18 is a top plan view of the unit of FIG. 17;

FIG. 19 is a partial top plan view of an alternate collar assembly for the unit of FIGS. 17 and 18;

FIG. 20 is a side elevation view of another embodiment of the stay slide adapted with a yoke for attachment to the sail halyard at the upper end of a standard rotary bearing;

FIG. 21 is a partial top plan view of the stay slide and yoke assembly of FIG. 20;

FIG. 30 is a front elevation view of an alternate embodiment of the stay slide that provides a means for quick release of the slide from the bushing or forestay when the gear is in the use position;

FIG. 31 is a side elevation of the alternate embodiment of FIG. 31;

FIG. 32 is a vertical section view taken along the line 32—32 of FIG. 31;

FIG. 33 is a top view of the assembly of FIGS. 30–32 showing the keeper plate in the closed position;

FIG. 34 is a perspective of an alternative arrangement of the stay slide and bushing in which the bushing is a sleeve adapted to receive the slide; this figure also shows an anti-rotation collar for the luff wire stay;

FIG. 35 is a fore and aft section view of the embodiment shown in FIG. 34 showing the slide not yet engaged with the sleeve and showing the anti-rotation collar integral with the sleeve;

FIG. 36 is a section view of the assembly along the line 36—36 of FIG. 34;

SUMMARY

Figure 2:
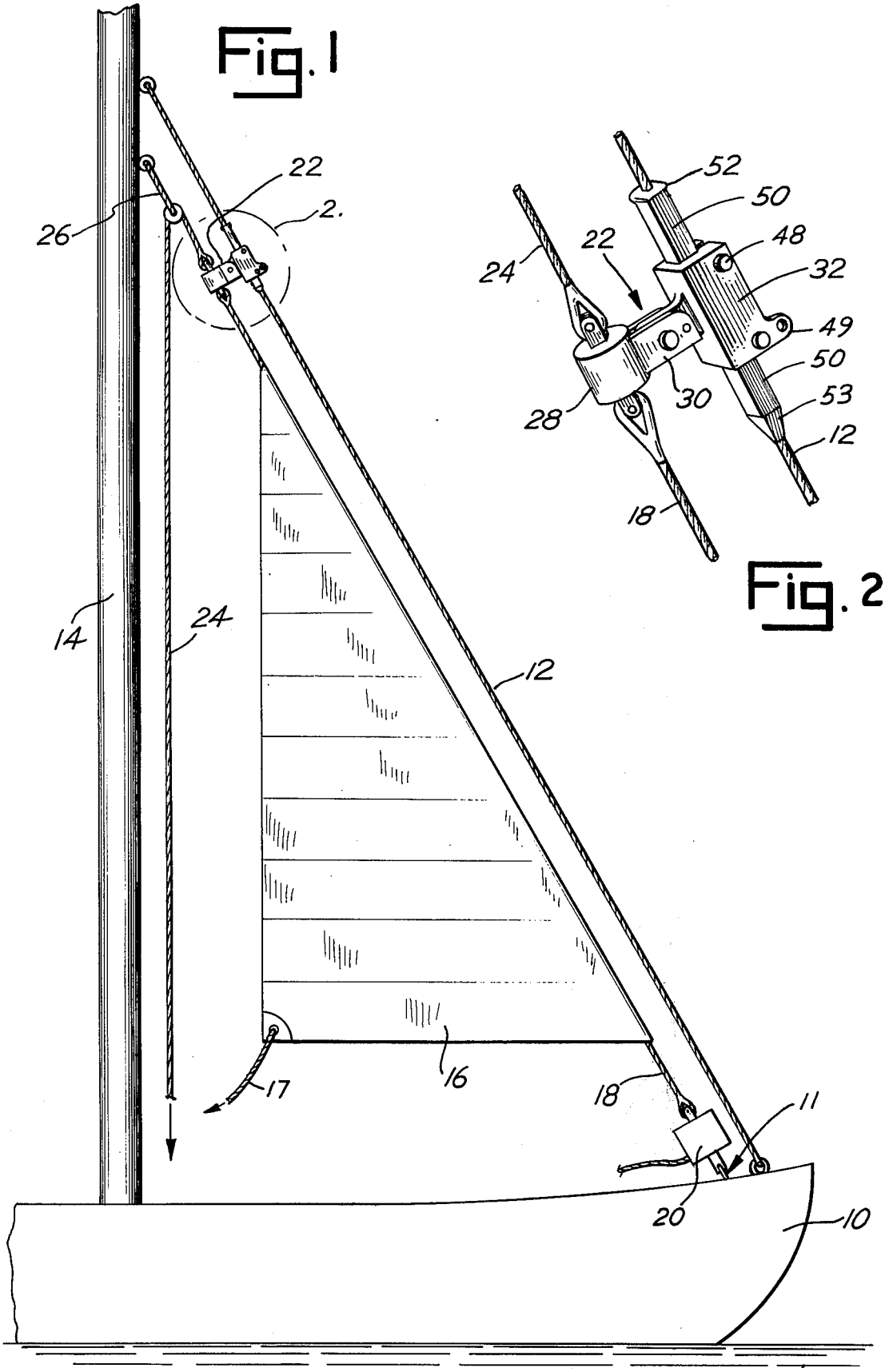
FIG. 2 is an enlarged view of the furling gear unit encircled in FIG. 1.

The invention provides a plurality of embodiments of anti-fouling upper furling gear apparatus which comprise a stay slide that is adapted to cooperate with a bushing secured to a stay. Both female and male embodiments of the stay slide are disclosed which cooperatingly receive or are received in correspondingly male or female stay bushings. The stay slide is also adapted to be connected to a bearing halyard or luff wire pin, or to be secured to a bearing housing or to receive a rotary bearing. Quick mount, dismount stay slide assemblies having spring-biased locking pin or keeper plates are disclosed. The stay slide and bushings are adapted with corresponding cooperating means to control the amount of rotation of the slide and bearing housing around the stay bushing within predetermined limits, which may range from substantially no rotary or torsional movement to a desired amount of arcuate motion, say up to about 270°. The cooperating means may include mating cross-sections for the stay slide (bore or outer surface) and bushing (outer surface or interior of collar) selected from arcuate or polygonal cross-sections, including round, polyarcuate, square, rectangular, triangular, and the like. The bearing housing connector or retainer, or the halyard or luff wire pin assembly may be connected to the stay slide by a rigid or articulatable strut member to provide a predetermined, fixed or adjustable distance therebetween. The strut may retain one or more bearing housings, which may be pivoted to provide proper angular relationship between forestay and luff wires. The bearing housing or strut is adapted to have a halyard attached thereto, while each bearing is adapted to have a sail luff wire attached to it. A downhaul rig may be included in the assembly. The stay bushing may be a preassembled part, such as cast, swaged or otherwise secured to the forestay, or it may be a user-assemblable unit securable to the forestay or forestay terminal. A special locking collar may be used to prevent terminal unthreading during use. The apparatus of the invention provides a quick mount and dismount of a roller sail to a stay and prevents fouling of the sail and its tackle around the stay during raising, lowering, furling, unfurling and in use in heavy weather.

DETAILED DESCRIPTION

The following detailed description of the several embodiments is by way of illustration and example and not by way of limitation of the principles of the present invention.

Referring first to FIG. 1, bow 10 of a sailboat has a forestay 12 extending between the bow 10 and a mast 14. A jib sail 16 is supported on a luff wire 18 which extends between a rope reel 20 attached to the deck 11 and/or lower end of the forestay 12 and an upper furling gear unit 22. The upper furling gear unit 22 is attached to the forestay 12 and halyard 24 by means hereinafter explained in more detail. A halyard 24 is attached to the upper end of the furling gear unit and is led through a block or blocks 26 attached to the mast for hoisting the sail. The rope reel 20 is used for rotating the luff wire 18 to furl the sail 16 and its sheet 17.

As seen in more detail in the embodiments of FIGS. 2–16, the anti-fouling upper furling gear unit 22 to which the invention herein is particularly directed comprises a rotary bearing housing 28, an elongated strut means 30 having one end attached to the rotary bearing housing, and a stay slide 32 attached to the opposite end of the strut means 30. As is explained in more detail below, with respect to FIGS. 4, 6, 6*a*, 8, 10, 10*a*, 11*a –c*, 13, 15, 15*a* and 16, the stay slide is adapted to engage the forestay 12 in a manner so that it will not rotate with respect thereto or at least that the rotation with respect to the stay will be within predetermined limits. The embodiments of FIGS. 17–21 show an alternate embodiment employing a collar, yoke or eye assembly portion of the stay slide which is adapted to retain and be secured to a conventional bearing, or the pin of the halyard or luff wire. FIGS. 22–25 show user-assemblable stay bushing assemblies used with this invention.

Referring first to the bearing housing-containing embodiment, a rotary bearing 34 (FIG. 3) is disposed in the housing 28 and is mounted for rotation therein preferably on roller or ball bearings 36. A projecting member 37 connected coaxially to the lower portion of bearing 34 and forming a part thereof extends through an opening 38 in the lower portion of the bearing housing 28. An extension 39, which may be in the form of an eye or fork, is connected to the member 37 and is adapted to have attached thereto the upper end of the luff wire 18. This is usually done by an appropriate shackle and shackling pin. A rotary bearing plug 40 is threadedly inserted into the upper side of the housing 28 and has formed thereon tang or yoke (fork or eye) means 42 to which the halyard 24 is adapted to be shackled.

Figure 3:
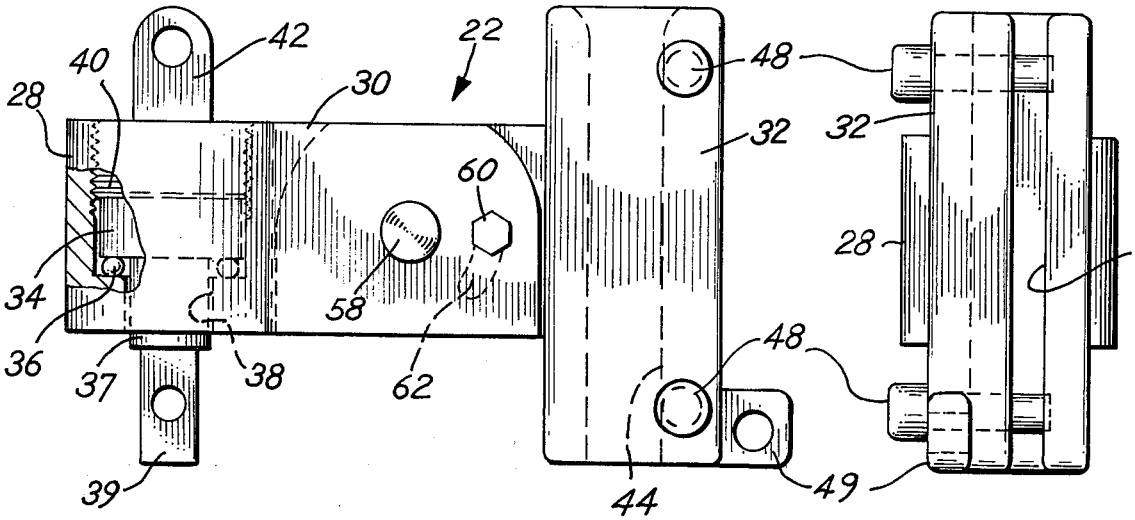
FIG. 3 is a more detailed view in elevation of the furling gear unit of FIG. 2.
Figure 5:
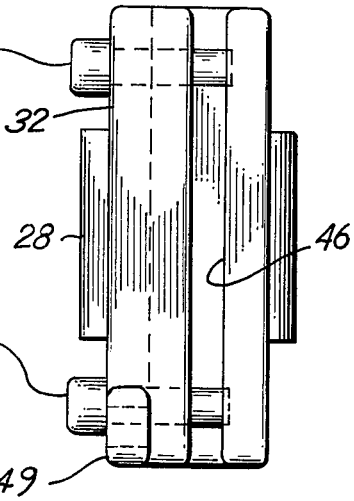
FIG. 5 is an end view of the unit of FIG. 3.

The stay slide 32 is an elongated member having formed therein an elongated bore 44 shown in FIG. 3 as being of a configuration square or rectangular in cross-section. The stay slide 32 preferably is formed with an elongated slot 46 (FIG. 5) wide enough to clear the stay and which runs the full length of the stay slide to provide for easy attachment or removal of the stay slide onto and from the stay. A pair of stay retaining pins 48, which may be spring loaded, are mounted in the stay slide 32 for purposes of retaining the stay slide on the forestay 12. A downhall attachment lug 49 is attached to the lower end of the stay slide and is adapted to have a downhall line attached thereto by a shackle or other suitable means (not shown).

The stay slide 32 is adapted to engage an elongated stay bushing 50 which is secured to the forestay 12 such as by swaging or some other suitable means. The stay bushing 50 also is of a corresponding square or rectangular cross-section so that there is no rotation of the unit 22 with respect to the stay bushing when the unit 22 is securely mounted on the stay bushing. The upper end of the stay bushing 50 is provided with a lip 52 which defines the limit of the upward movement of the stay slide on the bushing 50. The lower end 53 of the stay bushing is tapered to facilitate entry of the bushing into bore 44 when the jib is raised by halyard 12.

The limitation of rotation feature of the furling gear unit 22 with respect to the stay bushing is an important feature of this invention. In the course of furling or unfurling the sail 16, this particular type of connection between the stay slide and stay bushing prevents fouling by preventing rotation of the bearing housing 28, the block 26, the sail 16, and the luff wire 18 around the stay. This becomes especially important under adverse weather conditions.

It will be apparent that other cooperating configurations between the stay slide and stay bushing may accomplish this non-rotating objective. Such configurations may include, for example, cooperating round cross-sections with a key and groove arrangement, with the key forming an integral part of either the stay slide or stay bushing. It will be seen from this disclosure that other multi-sided cross-sectional configurations, accomplish the same purpose. As described hereinafter, other cooperating configurations may provide for a predetermined, limited amount of rotation between the stay slide and stay bushing.

The strut means 30 interconnecting the rotary bearing housing 28 and stay slide 32, generally speaking, may be a rigid member set at a right or acute angle to the upper stay slide. In the particular embodiment disclosed in FIGS. 3, 4 and 5 a pivoting strut is disclosed which can rotate in only one direction around a pivot pin 58. The strut means 30 includes a bifurcated arm or yoke 54 (FIG. 4) which is formed integral with the bearing housing 28. Elongated arm 56, formed integral with the stay slide 32, is pivotally mounted in the bifurcated arm 54 by means of a pivot pin 58. A bolt and slot arrangement 60, 62 define the limits of rotation of the bearing housing 28 with respect to stay slide. The slot 62 is formed in the arm 56 with the bolt 60 extending through the slot 62 and the arm 54. The arm 54 can rotate in only one direction. This particular arrangement provides for adjustment of the axial alignment between the bearing housing 28 and the stay slide 32 for special applications such as running sails. Alignment adjustment is maintained by tightening the bolt 60. The yoke 54 and arm 56 may be reversed, being attached respectively to upper stay slide 32 and bearing housing 28.

While the foregoing description should make the operation apparent, the operation of the furling gear embodying the invention herein will be briefly summarized. After attaching a furling gear unit 22 to the stay 12 by passing the stay through the slot 46, upper and lower ends of a sail luff wire 18 are shackled respectively to the extension 39 of the upper rotary bearing 34 and the rope reel 20. The sail is then hoisted into place as shown in FIG. 1 by means of the halyard 24. The stay slide 32 slides over taper 53 onto the stay bushing 50, with the upward movement of the former being limited by the lip 52. Furling or unfurling of the sail may be accomplished without any rotational movement being transmitted to the halyard 24, and thus no twisting of the halyard occurs. In view of the type of connection between the stay slide and stay bushing, no rotation of the rotary bearing, sail and halyard around the stay occurs, even during heavy weather. Thus, twisting and fouling are prevented, and the roller furling gear does not become inoperative. In addition, the construction of the unit 22 is such that a predetermined, fixed or adjustable distance between the stay and sail luff wire is maintained, this distance being sufficient to permit clearance between the furled sail and forestay.

On larger vessels with larger sails, some tortional strain may be put on the wire rope of the mast stay when the vessel sails off the wind on a reach or run. This strain would be transmitted from the sail via the upper furling gear unit and the stay bushing. Further, the forestay may become rotationally twisted in use or upon turnbuckle tensioning. In such cases, the swaged stay bushing also rotates slightly, and the upper roller furling assembly, and to a lesser extent, the sail could become misaligned from the centerline of the craft. The following embodiments compensate for such conditions.

FIGS. 7 through 16 show other embodiments of the stay slide and stay bushing which allow predetermined limited rotation of the stay slide around the stay bushing. These designs will alleviate the above referred to torsional stress or twisting which might occur with the design shown in FIGS. 2 to 6.

Figure 4:
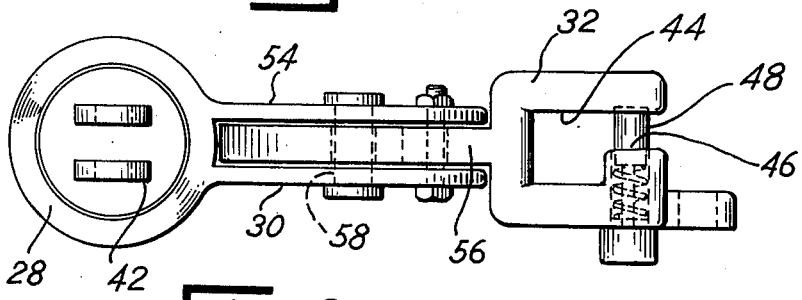
FIG. 4 is a top plan view of the unit of FIG. 3.
Figure 6:
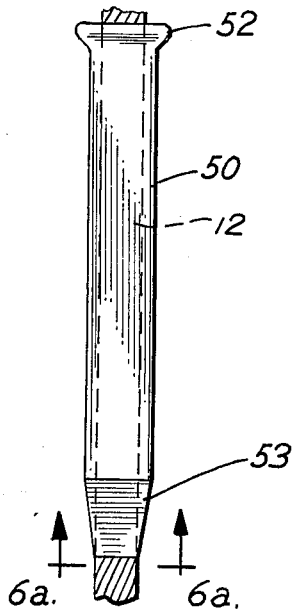
FIG. 6 is a view in elevation of a stay bushing attachable to the upper end of the mast stay.
Figure 6A:
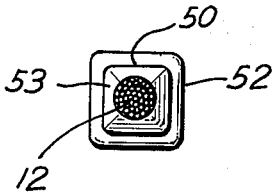
FIG. 6*a* is a view taken along the line 6*a*—6*a* of FIG. 6.

The embodiment disclosed in FIGS. 7 through 11*c* shows a modified form of a furling gear unit 70 with the principal modification being in the stay slide. It includes a rotary bearing housing 28 and a stay slide 72 interconnected by a strut means 74 which in this case is shown as a rigid strut means by way of simplifying example. The bearing housing 28 and strut means 74 could be of the same type as shown in FIGS. 3 and 4.

The stay slide 72 comprises essentially an elongated tubular structure split in half axially to define two elongated halves each substantially semi-circular in cross-section, the first half 76 being connected to and formed integral with the strut means 74 and the second half 78 being connected to the first half by an axially extending hinge joint 80. The two halves thus open with respect to each other to receive the stay and stay bushing therein. A retaining pin 82 is used to secure the two halves in closed position and is removed in order to position the stay slide around the stay 12. When both halves of the stay slide 72 are closed, it defines a substantially circular bore 84 interrupted by a radially inwardly projecting lug 86 which runs the length of the bore 84. A downhall lug 49 is formed at the lower end of the stay slide.

Figure 7:
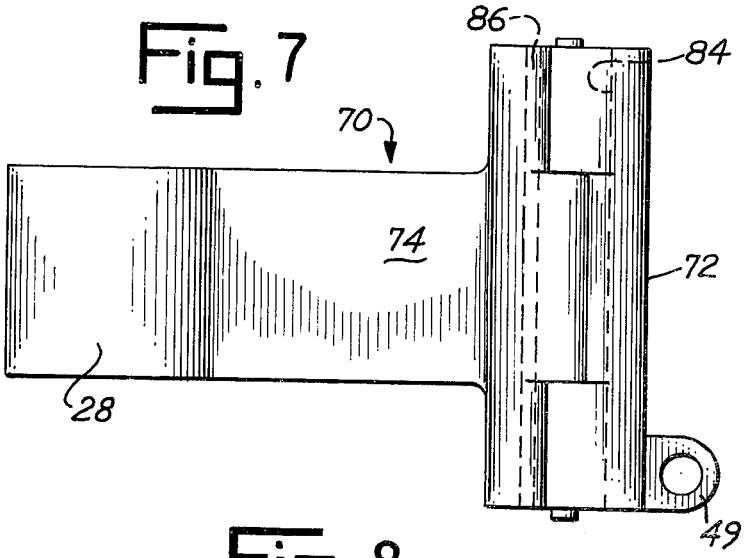
FIG. 7 is a view in elevation of another embodiment of a furling gear unit having a different means of attachment to the stay bushing.
Figure 9:
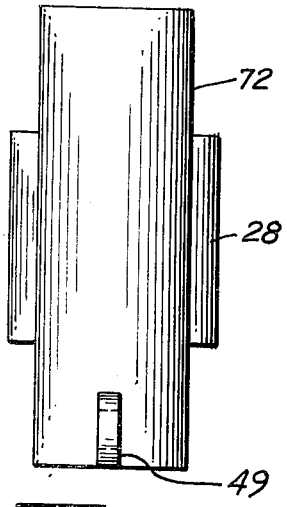
FIG. 9 is an end view of the unit of FIG. 7.
Figure 8:
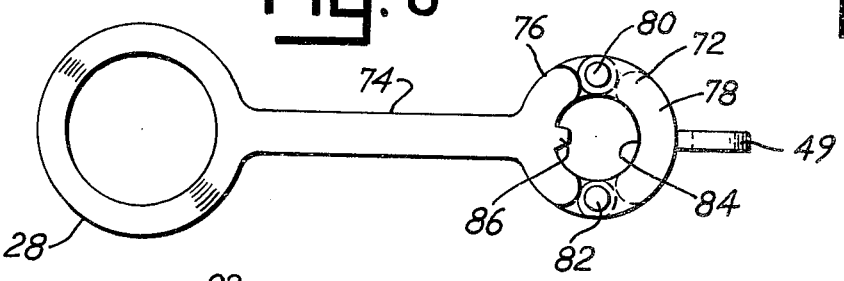
FIG. 8 is a top plan view of the unit of FIG. 7.
Figure 10A:
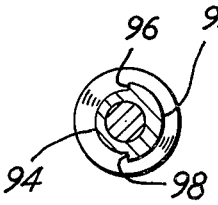
FIG. 10*a* is a view taken along line 10*a*—10*a* of FIG. 10.
Figure 11A:
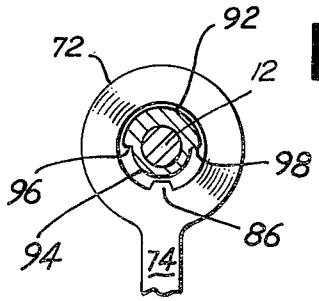
FIGS. 11*a*, 11*b* and 11*c* illustrate different positions of the furling gear unit with respect to the stay bushing.
Figure 10:
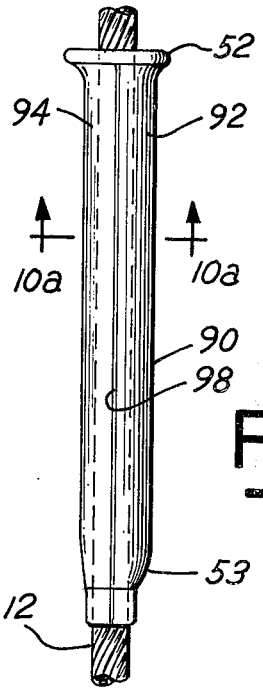
FIG. 10 is a view in elevation of a modified form of stay bushing used in connection with the unit illustrated in FIG. 7.
Figure 11B:
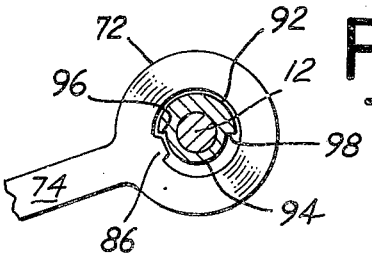
Figure 11C:
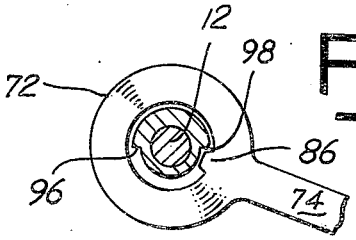

The elongated stay bushing 90 which is attached to the upper end of the forestay 12 has a cross-section as shown in FIG. 10*a* which defines a large semi-cylindrical surface 92 of a relatively large radius extending substantially one-half way around the stay bushing and a small semi-cylindrical surface 94 of a relatively smaller radius extending the remaining distance around the stay bushing. The interconnection of these cylindrical surfaces 92 and 94 define a pair of stops 96 and 98. A retaining lip 52 is formed on the upper end of the stay bushing. As will be seen from FIGS. 11*a* through 11*c*, when the stay slide 72 is positioned on the stay bushing 90, the entire upper unit 70 is capable of rotating a part of the distance around the stay bushing. Such rotation is limited by the contact of the lug 86 with the stops 96 and 98 on the stay bushing. Other than this modification of the engagement of the stay slide with the stay bushing allowing relative rotation of the upper furling gears fitting about the stay bushing, the operation of the units shown in FIGS. 3 and 7 is substantially the same.

The embodiment disclosed in FIGS. 12 through 16 shows still another modified form of an upper furling gear unit 102. It includes a rotary bearing housing 28 carrying a rotary bearing as shown in FIG. 3 and a stay slide 104 interconnected by strut means 74. The strut means 74 may be a rigid or a pivoting type strut means. The stay slide 104 comprises an elongated member through which is formed a partial cylindrical bore 106 defined by the cylindrical surface 108 of a relatively large radius as shown in FIGS. 12 and 13. This surface as shown extends approximately 240° in angular displacement, being arranged substantially symmetrically with reference to the plane of the strut means. A cylindrical surface 110 of a relatively smaller radius extends the remaining approximately 120°. The surface 110 is interrupted by the longitudinally extending slot 112 through which the stay 12 may pass to be received in the stay slide. The interconnection of the surfaces 108 and 110 define a pair of stops 114 and 116. A plurality of spring-biased or screw pins 118 are disposed in the stay slide to retain the stay 12 within the bore 106.

FIGS. 15, 15*a* and 16 show an elongated stay bushing 120 having a cross-section which defines a partial large cylindrical surface 122 of a relatively large radius and a partial small cylindrical surface 124 of a relatively small radius. The larger cylindrical surface 122 of the stay bushing cooperates with the larger cylindrical surface 108 of the stay slide 104. The smaller cylindrical surface 124 cooperates with the smaller cylindrical surface 110 of the stay slide. Stops 126 and 128 are formed by the intersection of the larger and smaller cylindrical surfaces 122 and 124. In the assembly of the stay slide 104 on the stay bushing 120 it will be apparent from viewing FIG. 16 that the stay slide is capable of limited rotation of an arc of approximately 150° or whatever other predetermined limitation is desired in the structure. The cooperating stops 114 and 116 on the stay slide and the stops 126 and 128 on the stay bushing cooperate to define the limits of rotation of the stay slide with respect to the stay bushing. Here again this modification of the engagement of the stay slide with the stay bushing allows relative rotation of the rotary bearing and stay slide about the stay bushing. The operation of the unit shown in FIG. 12 is substantially the same as that shown in FIGS. 3 and 7.

It will be apparent that this invention advantageously provides an upper furling gear unit which is effective to prevent twisting of the sail halyard during furling or unfurling of the sail. Furthermore, the invention is effective to prevent fouling in that twisting of the sail luff wire, block, sail, and halyard around the stay is prevented. Furthermore, it will be noted that the sail can easily be removed while under way without the danger of fouling merely by slackening off on the halyard and unloosening the shackled luff wire from the rotary bearing unit. In the modifications of FIGS. 7 through 16, units are provided with the additional feature of permitting a limited amount of rotation of the furling gear unit about the stay in order to avoid torsional stresses.

Referring now to FIGS. 17–21, these embodiments do not require an integral rotary bearing or bearing housing, but include means for attaching the stay slide to the sail assembly, either a conventional rotary bearing by means of a collar or the like, or a yoke or eye specially adapted to be shackled to the halyard or luff wire above or below the bearing. In FIG. 17 the stay slide 32 is of the type shown in FIG. 7, but it may be any of the other types disclosed herein. Likewise, strut 30 is shown for simplicity as rigid, but it may be articulated. Secured to (FIG. 18) or part of (FIG. 19) strut 30 is a collar or other bearing or bearing housing retaining member 280. As shown in FIGS. 17 and 18, the collar 280 is secured to the strut 30 by rivets or bolts 281, 282. The collar may be welded or formed as part of the strut. Set screw 283 may be used to insure the bearing assembly 284 is secured in the collar. In the alternative, other means may be used to secure the bearing in the collar, such as keying the bearing and collar to each other, or using an apertured retaining plate through which fork or eye 285 or 286 passes. FIG. 19 shows an alternate form of the collar in which securing means 281 (FIG. 18) is replaced by spot welding 287.

FIGS. 20 and 21 illustrate another embodiment in which the means attaching the stay slide and strut assembly 30, 32 to the rigging is a yoke 380 secured by pin 381 to either the upper fork 285 and halyard 24, or to the lower fork 286 and luff wire 18. Where desired, the fork 380 may be an eye, but a fork is preferred for better anti-rotational stability. The assemblies of FIGS. 17–21 are specially adapted for ease of mounting the anti-fouling roller furling gear of this invention in the field, and by users themselves, particularly on pre-existing halyard-luff wire assemblies having bearings.

Figure 22:
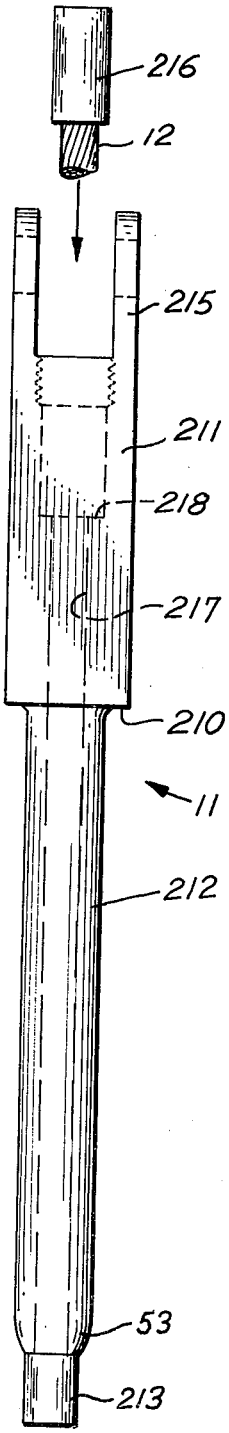
FIG. 22 is a section view of one embodiment of a stay slide bushing and yoke assembly for the forestay.
Figure 23:
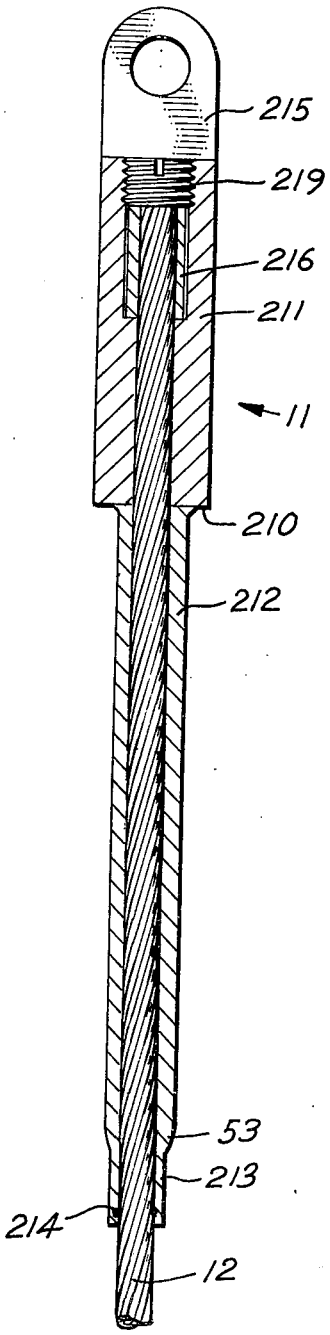
FIG. 23 is a section view of the assembly of FIG. 22 taken at right angles to FIG. 22.

FIGS. 22–25 illustrate embodiments of the forestay bushing that are likewise field or user mountable. FIG. 22 is a view partly in section and partly in perspective showing the stay bushing without the stay, while FIG. 23 shows the same bushing with the stay mounted therein. The stay bushing 11 has an upper coupling portion 211 and a bushing surface portion 212 which adjoin each other at shoulder 210. The lower end of the stay bushing assembly 11 terminates in tapered portion 53, and may have a swageable collar 213 for gripping the stay 12. Optionally O-ring 214 may be used to prevent corrosion from advancing up the stay into the interior of the bushing 11. In this embodiment, bushing assembly 11 is terminated at its upper end with a fork 215 for shackling to the mast. A stay 12 having a standard terminal or collar 216 is threaded through the axial bore 217 of the bushing assembly 11 until the collar seats against shoulder 218. A plug 219, optionally with a sealing gasket (not shown) is threaded into the upper end of the bore as shown to make a tight and secure seal. The plug may be sized to provide some axial compression of the collar 216 to insure a secure fit. The stay collar 213 is then swaged onto stay 12.

Figure 24:
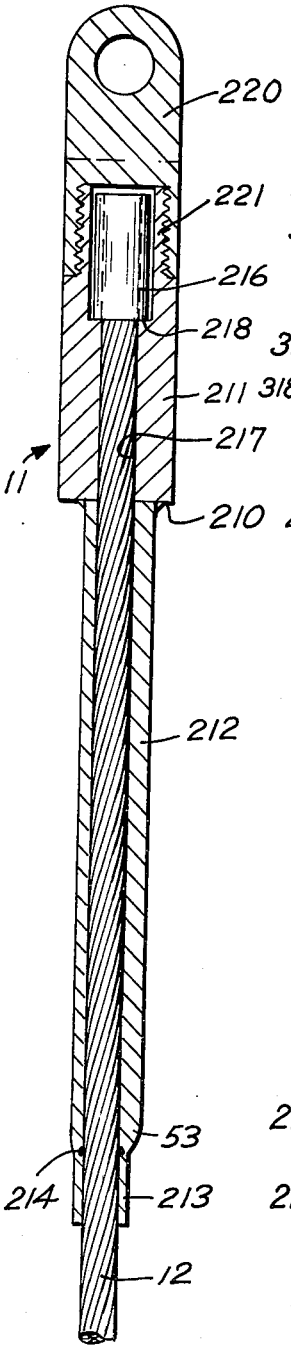
FIG. 24 is a section view of another embodiment of a stay slide bushing and eye assembly.

FIG. 24 shows an alternate embodiment wherein the upper fork terminus of bushing assembly 11 is replaced by an eye 220 in the form of a threaded cup adapted to be received by threaded portion 221 of the stay bushing. Other parts shown are the same as in FIGS. 22 and 23.

Figure 25:
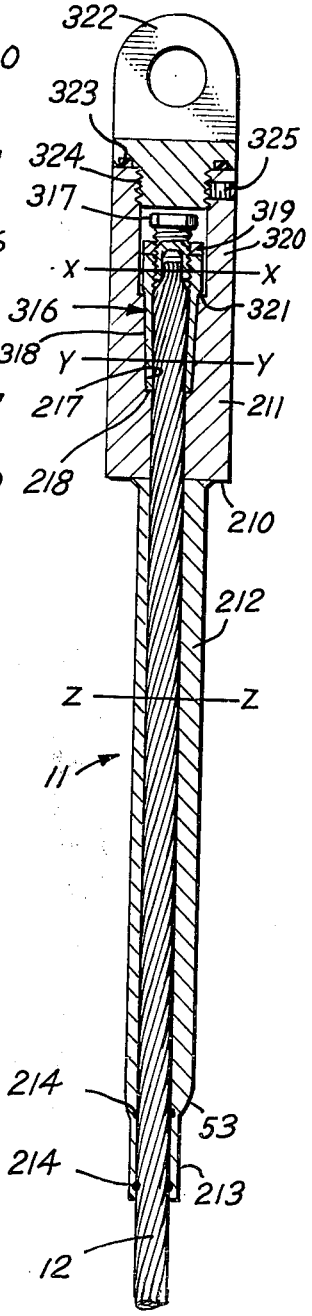
FIG. 25 is a section view of a stay slide assembly adaptable for a yoke or eye terminal adapted for use with conventional swageless fittings.

FIG. 25 illustrates still another embodiment in which a modified swageless terminal 316 is used in connection with stay bushing assembly 11 adapted to receive the terminal and stay. The lower portion of the bushing is as above described, but it should be understood that the end portion 213 is not required to be swaged, particularly where the O-ring seal 214 is employed. As shown in FIG. 25, the stay terminal 316 terminates in a hex head endbolt 317 which is threadedly engageable with a terminal body portion 318, and secured thereto by a locknut 319.

Figure 42:
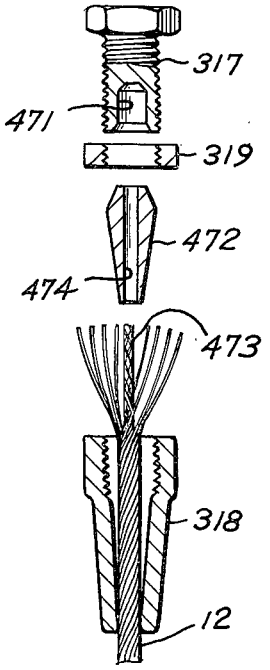
FIG. 42 is an exploded view of the endbolt assembly shown in FIG. 25.

As best seen in FIG. 42, the interior end of the endbolt 317 may be recessed out at 471 to receive the ends of the stay wires 12. Securing of the stay wires in the terminal 316 is accomplished by an axially bored compression cone 472 which is bi-tapered medially toward each end. The outer wires of stay 12 are unwrapped, and the cone inserted with the inner stay wire core 473 passing into the cone bore 474, and the outer wires passing over the outer double taper. The cable/cone assembly is inserted in body 318, endbolt 317 screwed into the body and tightened, and lock nut 319 being applied and tightened. A conventional terminal body cone and lock nut of the "Norseman" type may also be used.

The stay bushing assembly is then slid up the stay so that the stay bushing assembly body 320 receivingly engages the swageless terminal 316 so the terminal 318 body seats against shoulders 218 and/or 321. End piece 322, which may be a fork as shown, or an eye or stud, is threaded into the bushing body at 324, with gasket 323 being employed to seal the fitting. Set screw 325 may be employed to prevent unthreading of the end piece 322 from the bushing body 320.

In cross-section, the bore 217 of the bushing assembly 11 at the point X—X is hexagonal, square, octagonal or the like to receive the corresponding shape of swageless terminal body 318 and prevent turning. At point Y—Y the bore is circular, and axially tapered as shown to provide a tension-bearing surface, and at Z—Z the bore is circular to receive the stay.

Optionally, the end piece 322 may be integral with end bolt 317, in which case threads 224 are replaced by a smooth bore with lock nut 319 being omitted, the locking being provided by the set screw 325.

Figure 26:
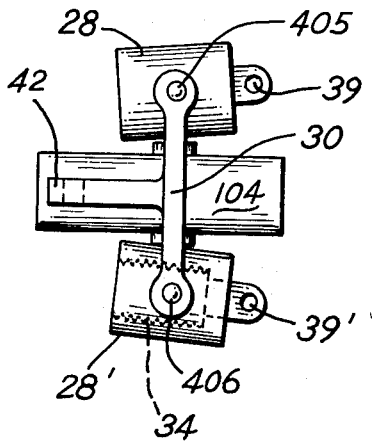
FIG. 26 is a rear elevation view of another embodiment of the anti-fouling roller furling gear of this invention for use with twin running sails hoisted on a single halyard.
Figure 27:
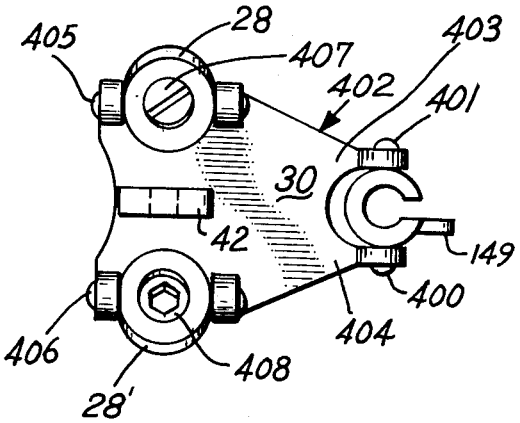
FIG. 27 is a top view showing the twin assembly of FIG. 26.
Figure 28:
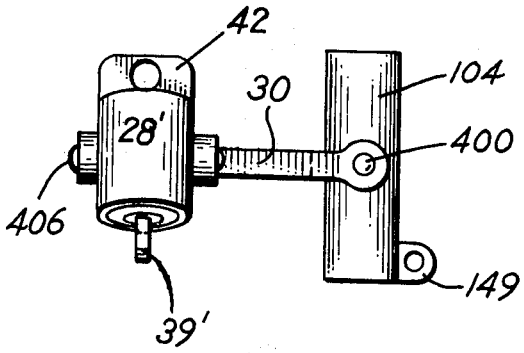
FIG. 28 is a side elevation view of the twin gear of FIGS. 26 and 27.

FIGS. 26–28 illustrate another embodiment of the invention used with twin running sails hoisted on a single halyard. Twin rotary bearing housings 28, 28' are mounted on a single stay slide 104. Strut 30 is pivotally connected at 400 and 401 (FIG. 27) to the stay slide. The stay slide may be any of the types herein, and that shown for illustration is similar to the stay slide of FIGS. 12 and 13. The strut 30 has a single halyard eye 42, which optionally may be a fork. The eye or fork is generally located along the fore-aft centerline. It is shown at the aft end of the assembly but may be placed further forward for mass balance or convenience in uphauling. The forward portion 402 of the strut 30 is relieved to form a fork with arms 403, 404 for receiving the stay slide 104. As shown, the bearings 34 (FIG. 28) are received in housings 28, 28' which are articulated on pivot pairs 405, 406. This permits the bearings to toe out at the bottom as the luff wires form an acute angle to the forestay. Eyes or forks 39, 39' are provided on the base of the bearings to receive the luff wires. The tops of the bearings are sealed with threaded plugs 407, 408; these plugs may be secured with a screwdriver as the slot in the plug top 407 illustrates, or may be adapted with a wrench-receiving lug in top 408. The downhaul lug 149 need not be on the stay slide portion, and may conveniently be placed on the strut or arm 30.

Figure 29:
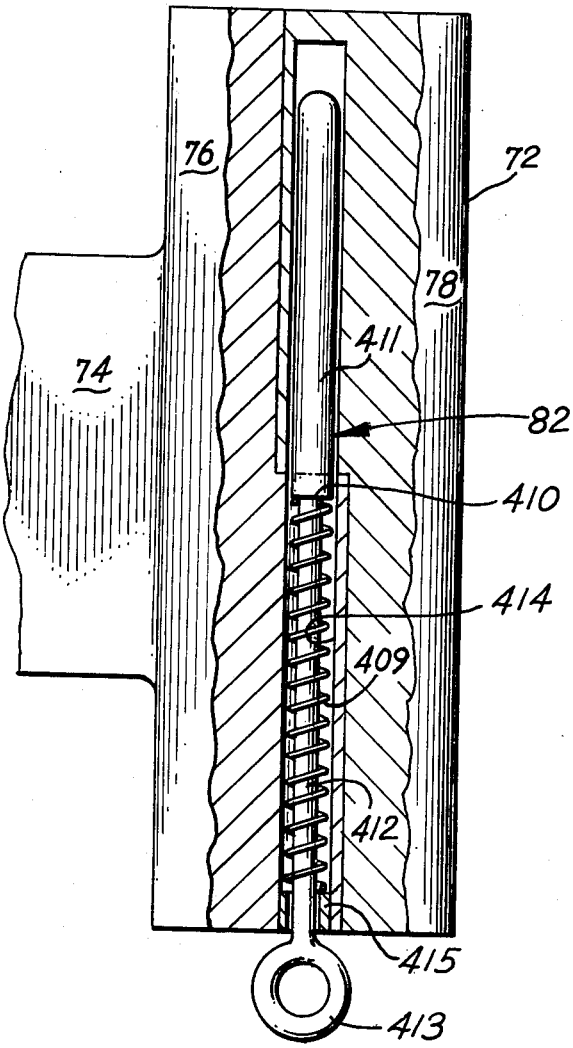
FIG. 29 is a view partly in section of a modified stay slide of FIGS. 7-9 showing a spring-biased, releasable hinge pin in place of the pin 82 of FIG. 8.
Figure 37:
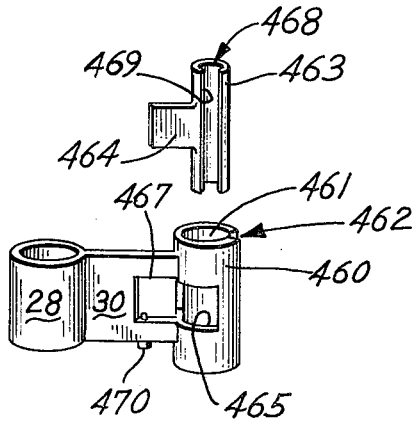
FIG. 37 is an exploded perspective view of an alternate embodiment of a stay slide which is particularly useful with the assembly of FIGS. 34–36.

FIGS. 29–33 illustrate another embodiment having a quick-opening feature. FIG. 29 is a side view, partly in section of a stay slide of the type illustrated in FIGS. 7–9. Arm 74 connects the bearing (not shown) to the stay slide 72, which comprises a fixed portion 76 and an articulated portion 78, pivoted as in FIG. 8. In this embodiment, pin 82 is biased upward by spring 409 which bears against shoulder 410 on the upper enlarged portion of the pin 411. A narrowed shaft portion 412 passes through the center of the spring and terminates in a ring or eye 413. In operation, a lanyard is secured to the ring. When it is desired to open the stay slide to remove it from the bushing or the forestay, the lanyard is pulled and the upper portion 411 of the pin is withdrawn into the bore 414, permitting the articulated portion 78 to swing open at joint 80 (see FIG. 8). A retainer collar 415 is provided at the entry of bore 414 after the pin and spring are inserted. The collar may be press fit or threaded into the bore, or a set screw may be used to secure it in place.

FIGS. 30–33 show a second quick opening stay slide embodiment in which a sliding keeper plate is spring-biased in a closed position. For purposes of illustration, the stay slide of FIGS. 30–33 is similar to that of FIGS. 12–14 and 16, but may be any other type shown herein adapted to receive the keeper plate. Stay slide 104 has a central bore 106 and a stay slot 112 communicating therewith (FIGS. 30, 32, 33). Keeper plate 420 is disposed in a slot 421 formed in arm 422 of the slide 104 (FIG. 33). The leading edge 423 of the plate (FIG. 32) is disposed in a groove 424 in the other arm 425 of the slide 104. The groove is aligned with the slot, and the upper end of each have shoulders 426, 427 that help limit the upward travel of the keeper plate.

The keeper plate contains one or more slots 428, 429 adapted to receive guide pins 430, 431 secured in arm 422 of the slide. Spring 432 (FIG. 32) disposed in bore 433 biases the keeper plate upward against the guide pins 430, 431 and the shoulders 426, 427 closing the stay slot 112. The spring is retained in the bore by plug 434. The keeper plate is also provided with a lanyard aperture 435. In operation, to open the stay slide for removing it from or fitting it on a forestay, a lanyard secured in hole 435 is pulled downward to overcome the upper biasing force of spring 432. The keeper plate slides downward in slot 421 by the cooperative action of guide pins 430, 431 in slots 428, 429. The lanyard eye may be any means adapted for grasping. It is shown disposed in a downward extending tang 436, but may be on the main body 437 of the plate or elsewhere as desired.

FIGS. 34–41 illustrate another embodiment of the stay slide and bushing cooperating means. The embodiments described above may be characterized as a male bushing and female stay slide, while the embodiments of FIGS. 34–41 are characterized as a female bushing collar and a male stay slide. In addition, this embodiment shows an optional, separate or integral, anti-rotation collar to prevent loosening of the stay fittings described above.

FIG. 34 shows in perspective the male-type stay slide assembly 22 in operative position in the female-type stay bushing 11 which is in the form of a sleeve. Collar 450, which may be separate as in FIG. 34 or integral with sleeve 449 (FIG. 35) has a hexagonal or octagonal bore 451 to prevent the yoke or fork 222 from loosening with respect to the locknut 319 or the upper portion 452 of the fitting body 316. The fork 222 may include a hex or octagonal portion 453 for tightening against the locknut 319. The space 454 on either side of the arm 30, which is provided by slot 455 in the sleeve 449, permits predetermined angular movement of the stay slide with respect to the forestay 12, yet provides the anti-fouling capability of the furling gear. The sleeve 449 may be secured to the lower portion 456 of the fitting 316 by one or more set screws 457 and 458. The lower end of the bushing collar may be flared as at 459 to provide ease of entry of the stay slide 22.

Figure 38:
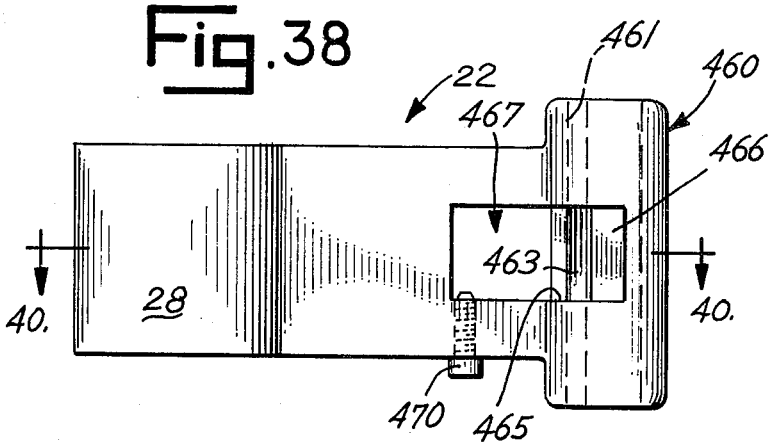
FIG. 38 is a side elevation view of the assembled parts of stay slide of FIG. 37 in which the forestay slot is open.
Figure 39:
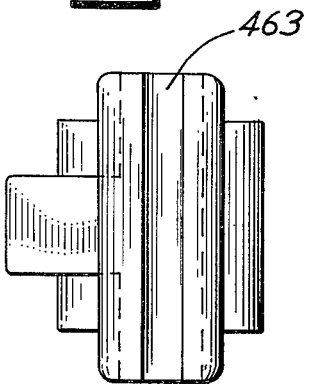
FIG. 39 is a front view of the stay slide of FIG. 38.
Figure 40:
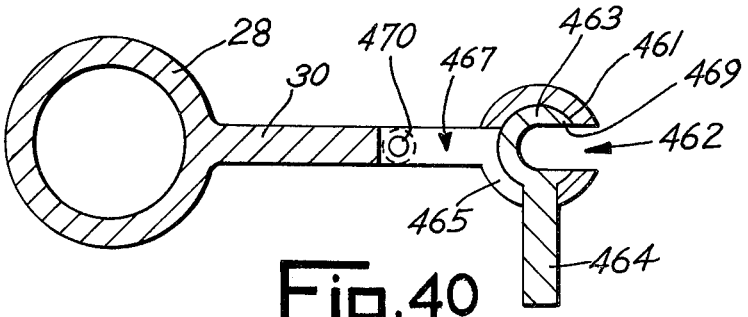
FIG. 40 is a section view along the line 40—40 of FIG. 38 showing the forestay slot open.
Figure 41:
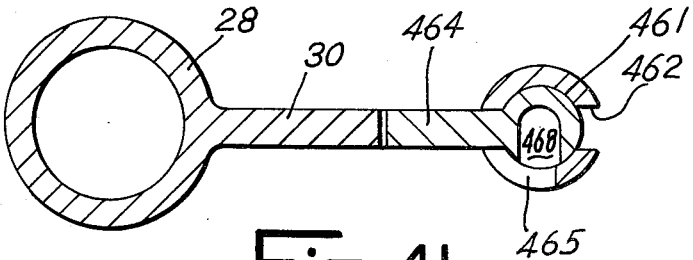
FIG. 41 is a section view along the line 40—40 of FIG. 38 showing the inner forestay retaining tube lever in the closed position.

FIGS. 37–41 show another embodiment of the stay slide assembly. As seen in perspective in FIG. 37, instead of using the female-type stay slide 32 of FIGS. 7–9, 17, 18, and 20, a male type slide 460 is used in combination with arm 30 and bearing collar 28. The slide 460 has a central bore 461 which communicates with a slot 462 adapted to receive the forestay 12 and a locking tube 463. As shown best in FIGS. 40 and 41, the locking tube 463 has an arm 464 secured to it which is adapted to rotate on bearing surface 465 which forms the bottom edge of slot 466 in the outer stay slide tube 460. The strut or arm 30 connecting the stay slide to the bearing collar 28 may optionally have an aperture 467 for receiving the locking tube arm 464, as best seen in FIGS. 38, 40 and 41.

The locking tube 463 also has a central bore 468 communicating with a slot 469 that is substantially similar in width to the slot 462 in the slide body 460. As seen by comparing FIG. 40, the open position, with FIG. 41 the closed position, when arm 464 is turned substantially at an angle of 90° with respect to arm 30, the two slots 469 and 462 align, and the forestay can be received in central bore 468. The arm 464 is then turned toward the arm 30 and received in the aperture 467. This rotation closes the slot 462, and the stay slide is vertically movably secured to the forestay. One or more spring detents, set screws, pins or other locking means 470 may be used to secure arm 464 in the closed position.

It should be understood that various modifications within the scope of this invention can be made by one of ordinary skill in the art without departing from the spirit thereof. I therefore wish my invention to be defined by the scope of the appended claims as broadly as the prior art will permit, and in view of this specification if need be.

I claim:

1. Anti-fouling roller furling sail handling apparatus comprising:

a. a stay bushing member adapted to be secured to a stay member;

b. a stay slide member having an elongated portion with an axial bore therethrough adapted to receive a stay;

c. said stay slide being adapted to slidably engage said stay bushing;

d. means for attaching said stay slide to sail tackle;

e. cooperating means on said stay slide and stay bushing adapted for controlling the amount of rotation of said stay slide about said stay bushing within preselected limits; and f. said apparatus thereby reducing fouling of sail and/or sail tackle around said stay when said sail is in a raised position during roller furling of the sail.

2. An apparatus as in claim 1 wherein said stay slide is a female type member or a male-type member, and said slide is adapted to cooperatingly engage a corresponding male-type or a female-type stay bushing member.

3. An apparatus as in claim 2 wherein said attachment means includes:

a. means for engaging a rotary bearing assembly.

4. An apparatus as in claim 3 wherein said engaging means comprises a collar adapted to receive a rotary bearing.

5. An apparatus as in claim 3 wherein said engaging means includes:

a. a rotary bearing housing;

b. means defining a rotary bearing disposed in said housing; and c. at least one of said housing and said bearing is adapted to have sail tackle attachable thereto.

6. An apparatus as in claim 3 wherein said sail tackle is a sail halyard, a sail luff wire, or a combination thereof.

7. An apparatus as in claim 6 wherein said attachment means includes:

a. an apertured member, and said apertured member is an eye or a fork, and b. said apertured member is adapted to receive a pin in association with said sail tackle.

8. An apparatus as in claim 7 wherein said apertured member and said pin are adapted to be used in association with an apertured projection of a rotary bearing assembly, and said apertured projection is an eye or a fork.

9. An apparatus as in claim 8 wherein said attachment means apertured member is adapted to receive a pin in association with both sail tackle and said rotary bearing assembly apertured projection.

10. An apparatus as in claim 7 wherein said stay slide attaching means includes:

a. means defining an elongated strut member to retain said attachment means and said stay slide member in spaced-apart relationship.

11. An apparatus as in claim 10 wherein said strut means is articulated.

12. An apparatus as in claim 11 wherein said strut means is articulated in a plane substantially including the axis of the stay slide bore.

13. An apparatus as in claim 12 wherein said strut means interconnecting said stay slide and attachment means includes:

a. a first member attached to said attachment means and a second member attached to said stay slide;

b. pivot means interconnecting said first and second members; and c. adjusting means on said strut means for securing said stay slide and attachment means in preselected angular positions with respect to each other.

14. An apparatus as in claim 11 wherein said strut means is articulated in a plane substantially at right angles to the axis of the stay slide bore.

15. An apparatus as in claim 14 wherein said strut includes:

a. means for engaging said stay slide, and b. pivot means disposed in said engaging means to provide said articulation between said strut and said slide.

16. An apparatus as in claim 15 wherein said rotary bearing engaging means is adapted to engage a plurality of rotary bearings.

17. An apparatus as in claim 16 wherein said bearing engaging means includes:

a. pivot means permitting the axis of said rotary bearings to be canted at an angle substantially parallel to the axis of a halyard or luff wire.

18. An apparatus as in claim 16 wherein said means for attaching said stay slide to sail tackle includes:

a. an apertured member secured to said strut member and adapted to engage a sail halyard, and said apertured member is an eye or a fork.

19. An apparatus as in claim 18 wherein said apertured member is disposed at the approximate center of mass balance of said assembly.

20. An apparatus as in claim 18 wherein said apertured member is disposed between said bearings substantially on a fore-aft axis.

21. An apparatus as in claim 2 wherein said stay slide includes:

a. an elongated slot communicating with and coextensive with said bore, said slot being adapted to pass a stay therethrough.

22. An apparatus as in claim 21 wherein said stay slide member includes:

a. reciprocable keeper plate means disposed to selectively close said slot and provide access to said slide bore via said slot.

23. An apparatus as in claim 22 wherein said keeper plate means includes:

a. means for biasing said keeper plate into a position closing said slot.

24. An apparatus as in claim 23 wherein:

a. said keeper plate means is adapted to engage means for moving said keeper plate against the force of said biasing means to a position in which said slot is open.

25. An apparatus as in claim 21 which includes:

a. selectively removable retaining pin means in said stay slide passing across said slot to retain a stay in said bore.

26. An apparatus of claim 2 wherein:

a. the bore of said stay slide is of polygonal cross-section; and b. said cooperating means comprise said polygonal cross-section bore and a corresponding polygonal outer configuration of said stay bushing, said cooperating means being effective to prevent rotation of the apparatus with respect to the stay with which it is associated.

27. An apparatus as in claim 26 wherein said polygonal cross-section is selected from square, rectangular, triangular and substantially arcuate.

28. An apparatus as in claim 2 wherein said stay slide elongated portion comprises:

a. a first and a second portion;

b. a hinge joint interconnecting said portions;

c. said portions are adapted to open to receive a stay in said bore;

d. means for releasably securing said first and second portions in a closed position.

29. An apparatus as in claim 28 wherein said securing means includes:

a. a bore in said first portion, b. a bore in said second portion which aligns with said first portion bore in the closed position, c. a reciprocably movable pin disposed in said bores.

d. said pin is adapted to be biased from a first position which prevents said slide portions from opening, to a second, recessed position which permits said portions to open, e. means for biasing said pin into said first position, and f. means for permitting said pin to be moved into said second position against the force of said biasing means.

30. An apparatus as in claim 2 wherein:

a. the bore of said stay slide is an elongated cylindrical surface which includes:

b. radially inwardly projecting and axially extending lug means formed on the surface defining said cylindrical bore; and c. means on said stay bushing defining circumferentially spaced stop means adapted to cooperate with said lug means on said stay slide to define the limits of rotation of said apparatus about said stay bushing and the stay to which the latter is adapted to be secured.

31. An apparatus as in claim 2 wherein:

a. said bore of said stay slide is defined in part by a first cylindrical surface of a relatively larger radius and in part by a second cylindrical surface of a relatively smaller radius, said first and second cylindrical surfaces being joined by radially extending surfaces to define a first pair of circumferentially spaced stop means; and b. means on said stay bushing defining third and fourth cylindrical surfaces of relatively larger and smaller radii, said third and fourth cylindrical surfaces being joined by substantially radially extending surfaces to define a second pair of stop means which are effective in the assembly to engage said first pair of stop means to define the limits of rotation of said apparatus about said stay bushing and the stay to which the latter is adapted to be secured.

32. An apparatus as in claim 2 which includes:

a. means defining a downhaul lug attached to at least one of said strut, said stay slide, or said attaching means.

33. An apparatus as in claim 2 wherein said stay bushing includes:

a. means for retaining a stay therein, and b. means for attaching said bushing to a vessel mast.

34. An apparatus as in claim 33 wherein said attaching means includes an apertured member, and said apertured member is a fork or an eye.

35. An apparatus as in claim 34 wherein:

a. said stay retaining means includes a stay terminal;

b. said stay bushing includes a body portion having an axial bore therethrough adapted to receive said stay;

c. said bore being enlarged at the upper end of said bushing body to receive said terminal;

d. said enlarged bore and said stay bore portions join along at least one bearing surface.

36. An apparatus as in claim 35 wherein said terminal is of the swageless type.

37. An apparatus as in claim 36 wherein said swageless terminal comprises:

a. a body portion having an axial bore therethrough to receive a stay, b. an inner member having an outer diameter sufficiently smaller than the diameter of said bore to receive stay wires in the annulus defined therebetween, and having a taper from the outer diameter toward the central axis of said inner member at the upper portion thereof, and c. means for compressing said stay wires against said cone being threadedly engageable with said body portion.

38. An apparatus as in claim 37 which includes:

a. means for preventing unthreading of said compression means from said terminal body.

39. An apparatus as in claim 38 wherein said unthreading prevention means comprises:

a. adapting said enlarged upper bore portion to slidably engage said terminal body and compression means while preventing rotation of one with respect to the other.

40. An apparatus as in claim 38 wherein:

a. said compression means includes a lock nut; and b. said unthreading prevention means comprises a collar having a bore that engages both said terminal body and said lock nut.

41. An apparatus as in claim 37 wherein:

a. said compression means has an upper end adapted as an eye or fork.

42. An apparatus as in claim 2 wherein:

a. said slide is male-type and said stay bushing is female type.

43. An apparatus as in claim 42 wherein said stay bushing includes:

a. means for receiving said slide defining a generally cylindrical collar, b. said slide includes a strut member, and c. said bushing collar includes a slot adapted to receive the strut of said slide.

44. An apparatus as in claim 43 wherein:

a. said collar slot is wider than said strut to provide a preselected amount of angular rotation of said slide around said stay.

45. An apparatus as in claim 44 wherein:

a. said collar is secured to a stay terminal means.

46. An apparatus as in claim 45 wherein:

a. said stay terminal includes a body portion adapted to threadedly engage stay compression means, and which includes:

b. means for preventing unthreading of said compression means from said terminal body portion.

47. An apparatus as in claim 46 wherein:

a. said compression means includes a lock nut; and b. said unthreading prevention means comprises a collar having a bore engaging both said lock nut and said terminal body portion.

48. An apparatus as in claim 47 wherein:

a. said collar is integral with said stay bushing collar.

49. An apparatus as in claim 45 wherein:

a. said stay bushing collar includes a flared lower end to permit ease of entry of said stay slide.

50. An apparatus as in claim 43 wherein:

a. said stay slide includes an elongated slot coextensive and communicating with said bore;

b. said slot being adapted to pass a stay therethrough; and which includes:

c. means for retaining said stay in said stay slide axial bore.

51. An apparatus as in claim 50 wherein said stay retaining means includes:

a. a tubular member having an axial bore and a coextensive slot communicating therewith, b. said tubular member slot and bore being adapted to receive and slidably engage said stay;

c. said tubular member being adapted to engage the inner surface of said slide axial bore;

d. said tubular member being rotatable from a first, open position wherein the slots in said slide and said tube align to receive said stay therethrough, and a second, closed position in which said slots do not align, retaining said stay in the axial bore of said tube.

52. An apparatus as in claim 51 wherein said tubular member includes:

a. radially projecting lug adapted to permit rotation of said tube in said slide axial bore, and to lock said tube in said closed position.

53. An apparatus as in claim 52 wherein:

a. said slide attaching means includes a strut member;

b. said slide member and said strut are apertured to receive said radial lug.

54. An apparatus as in claim 2 which includes:

a. means for retaining said stay in said stay slide axial bore.

55. An apparatus as in claim 54 wherein said stay retaining means includes:

a. a tubular member having an axial bore and a coextensive slot communicating therewith, b. said tubular member slot and bore being adapted to receive and slidably engage said stay;

c. said tubular member being adapted to engage the inner surface of said slide axial bore;

d. said tubular member being rotatable from a first, open position wherein the slots in said slide and said tube align to receive said stay therethrough, and a second, closed position in which said slots do not align, retaining said stay in the axial bore of said tube.

56. An apparatus as in claim 55 wherein said tubular member includes:

a. radially projecting lug adapted to permit rotation of said tube in said slide axial bore, and to lock said tube in said closed position.

57. An apparatus as in claim 56 wherein:

a. said slide attaching means includes a strut member;

b. said slide member and said strut are apertured to receive said radial lug.

58. An apparatus as in claim 57 wherein:

a. said slide is of female type, and said bushing is of male type;

b. the bore of said tubular member is of polygonal cross-section, and c. said cooperating means comprise said polygonal cross-section bore and a corresponding polygonal outer configuration of said stay bushing, said cooperating means being effective to prevent rotation of the apparatus with respect to the stay with which it is associated.

59. An apparatus as in claim 58 wherein:

a. said polygonal cross-section is selected from square, rectangular, triangular and substantially arcuate.

* * * * *

UNITED STATES PATENT AND TRADEMARK OFFICE

CERTIFICATE OF CORRECTION

PATENT NO. : 3,964,419

DATED : June 22, 1976

INVENTOR(S) : Ronald L. Uecker

It is certified that error appears in the above-identified patent and that said Letters Patent are hereby corrected as shown below:

Column 16, line 36, claim "45" should correctly read --43--.

Signed and Sealed this

Seventh Day of September 1976

[SEAL]

*Attest:*

RUTH C. MASON
*Attesting Officer*

C. MARSHALL DANN
*Commissioner of Patents and Trademarks*